US008072146B2

(12) United States Patent
Miyamoto et al.

(10) Patent No.: US 8,072,146 B2
(45) Date of Patent: Dec. 6, 2011

(54) FLUORESCENT LAMP

(75) Inventors: Kazuhiro Miyamoto, Tokyo (JP); Masayuki Kanechika, Tokyo (JP); Koji Kikuchihara, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 498 days.

(21) Appl. No.: 12/122,695

(22) Filed: May 17, 2008

(65) Prior Publication Data

US 2008/0265738 A1 Oct. 30, 2008

Related U.S. Application Data

(63) Continuation-in-part of application No. 12/031,886, filed on Feb. 15, 2008, now Pat. No. 7,764,009.

(30) Foreign Application Priority Data

Mar. 1, 2007 (JP) ..... 2007-051078
May 17, 2007 (JP) ..... 2007-131456

(51) Int. Cl.
*H01J 17/04* (2006.01)

(52) U.S. Cl. ..... 313/631; 313/311; 313/491

(58) Field of Classification Search ..... 313/311, 313/486, 491, 631, 642
See application file for complete search history.

(56) References Cited

U.S. PATENT DOCUMENTS

2005/0017627 A1 1/2005 Asai et al.
2005/0062392 A1 3/2005 Sakai et al.

FOREIGN PATENT DOCUMENTS

JP 2010647 1/1990
JP 4-149954 A 5/1992
JP 2005-276654 A 10/2005
JP 2005285587 10/2005

*Primary Examiner* — Bumsuk Won
(74) *Attorney, Agent, or Firm* — Kenealy Vaidya LLP

(57) ABSTRACT

The disclosed subject matter includes a fluorescent lamp and particularly a cold cathode fluorescent lamp that can be employed as a light source for a LCD backlight unit for a television, a computer, a display, and the like. The fluorescent lamp can include a couple of electrode units located opposite to each other at each end of a tube, a couple of welding beads sealing both the tube and the couple of electrode units, and a filler gas located in the tube. Each of the electrode units can include an emitter electrode that is configured with a crystalline silicon semiconductor material having an electrical conductivity or configured with other semiconductor materials, and can include a concave portion formed thereon. The electrode units can prevent blackening on an inner surface of the tube by avoiding the occurrence of spattering. Thus, the fluorescent lamp using the electrode units can enjoy a long life, high reliability, easy manufacture, and the like.

17 Claims, 9 Drawing Sheets

| sample | Accelerated life testing time | | | |
|---|---|---|---|---|
| | 100hours | 500hours | 1000hours | 2000hours |
| Comparative example 1 | ○ | × | — | — |
| Comparative example 2 | ○ | ○ | ○ | × |
| Embodiment 1 | ○ | ○ | ○ | ○ |
| Embodiment 2 | ○ | ○ | ○ | ○ |

FIG. 9

FLUORESCENT LAMP

This application is a continuation-in-part application claiming priority under 35 U.S.C. §120 to U.S. patent application Ser. No. 12/031,886 filed on Feb. 15, 2008 now U.S. Pat. No. 7,764,009 entitled Fluorescent Lamp, which claims priority under 35 U.S.C. §119 to Japanese Patent Application No. 2007-051078 filed on Mar. 1, 2007. This application separately claims priority under 35 U.S.C. §119 to Japanese Patent Application No. 2007-131456 filed on May 17, 2007. All of the above-referenced priority documents are hereby incorporated in their entirety by reference.

BACKGROUND

1. Field

The presently disclosed subject matter relates to a fluorescent lamp, and more particularly to a cold cathode fluorescent lamp which, in at least one embodiment, can be used as a light source for a back light unit of a liquid crystal display mounted in a television, a personal computer, display devices, and the like.

2. Description of the Related Art

In a liquid crystal display (LCD) using office automation equipment such as a personal computer, a printer and the like, a backlight unit is mounted on the back of the LCD in order to facilitate visualization of the LCD. A cold cathode fluorescent lamp (CCFL) is frequently used as a light source for the backlight unit. In general, fluorescent lamps can be broadly classified into CCFL and hot cathode fluorescent lamp (HCFL) type lamps. A reason why the CCFL is frequently used as a light source for the backlight unit is that the CCFL generates a small amount of heat and enjoys low power consumption.

Fluorescent lamps that are classified into CCFL and HCFL type lamps can be broadly composed of an electrode unit and a tube unit. For example, an electrode unit of a CCFL is generally composed of an electrode, a stem lead and a lead wire. Materials used to make the electrode include nickel, however, in recent years niobium, molybdenum, tungsten, etc., have been used. Because the stem lead is generally sealed with a bead made by glass and/or the like, it can be made from kovar™ (a nickel-cobalt ferrous alloy), tungsten, molybdenum, etc., for which thermal expansion behavior is similar to that of glass. The lead wire for connecting to outside parts can be a dumet wire or a nickel wire, etc.

Each connecting portion of the above described components can be connected with a weld such as a resistance weld, a laser weld, and the like, and their components can be assembled as the electrode unit. The tube unit is generally formed as a glass tube, which can be approximately 2 mm in outside diameter and from 10 mm to 1,000 mm in length, and can be coated with a phosphor on an inner surface thereof. The glass tube of the tube unit can be sealed along with the stem lead by the above-described glass bead.

Various components for a fluorescent lamp having high brightness and long life and a fluorescent lamp using these components are generally known. For example, Patent Document No. 1 (Japanese Patent No. 2792543) discloses an electrode for a fluorescent lamp that provides high power and long life by inhibiting an effect of spattering. In addition, Patent Document No. 2 (Japanese Patent Application Laid Open JP2005-285587) discloses an electrode for a CCFL that provides long life and high power by preventing a blackening on an inner surface of a glass tube.

Furthermore, Patent Document No. 3 (Japanese Patent Application No. 2007-051078) discloses a fluorescent lamp that provides long life and high reliability by including an emitter electrode configured with a crystalline silicon carbide material having an electrical conductivity. The electrode units including the above emitter electrode can prevent blackening on an inner surface of the tube by avoiding the occurrence of spattering.

The above-referenced Patent Documents are listed below and are incorporated herein by reference.

1. Patent Document No. 1: Japanese Patent No. 2792543
2. Patent Document No. 2: Japanese Patent Application Laid Open JP2005-285587
3. Patent Document No. 3: Japanese Patent Application No. 2007-051078

Recently, televisions and the like have been provided with LCD units including a backlight unit which requires longer life and higher brightness than that of office automation equipment, such as personal computers and the like. Thus, the CCFL that is used as a light source for the backlight unit mounted on the back of the LCD should have a longer life and higher brightness than the conventional CCFL. In addition, because television screens are getting larger and larger, the size of the CCFL is also becoming longer and the operating voltage is also becoming high.

The life of the conventional CCFL will now be described. A main factor that determines the life of a CCFL is blackening on an inner surface of glass tube near the electrode unit. The blackening on the inner surface can be caused by several factors, including: having electrode matter beaten out from the surface of the electrode due to the presence of mercury ions and/or the like; material, such as the electrode matter material, adhering on the inner surface of the glass tube near the electrode unit; and material, such as the electrode matter material, blackening the inner surface of the glass tube. The above-described blackening can cause a reduction of the life of the CCFL.

In order to prevent this blackening, molybdenum and tungsten that advantageously prevent spatter of mercury ions have been employed as the electrode material in place of nickel. However, because blackening cannot be adequately prevented even if molybdenum and/or tungsten are used as the electrode material, there is a problem in that a favorable life may not be obtained.

On the other hand, electrodes that add a relatively small amount of material having a low work function, such as a lanthanum and the like, to the molybdenum or tungsten have been proposed. In addition, a molybdenum electrode or tungsten electrode that includes 4 wt % to 10 wt % of at least one or more than one of lanthanum oxide, yttrium oxide, cerium oxide, strontium oxide, hafnium oxide and barium oxide and 0.05 wt % to 0.5 wt % in a weight ratio of at least one or more than one of nickel, cobalt and palladium has also been proposed. However, there is a problem in that these electrodes may not meet the life requirements of the CCFL, because the life of the CCFL which is used as a light source for the LCD backlight unit of a television and the like should be long.

Furthermore, the CCFL according to Patent Document No. 3 can provide long life and high reliability by including an emitter electrode configured with a crystalline silicon carbide material having an electrical conductivity. However, the crystalline silicon carbide material may not be easily formed into a large size wafer at low cost and with high quality in the present circumstances.

The disclosed subject matter has been devised to consider the above and other features, problems and characteristics. Thus, embodiments of the disclosed subject matter can include a fluorescent lamp with a simple electrode structure that can prevent blackening on an inner surface of the lamp tube and therefore can meet various requirements for a longer life, higher brightness and the like. In addition, the disclosed subject matter can include a CCFL having a relatively long life, high brightness and high reliability. More specifically, certain embodiments of the disclosed subject matter can provide a CCFL having a long life in which a decrease of brightness can be maintained at less than 50% as compared to the initial value of brightness even after continuous emission for 60,000 hours.

SUMMARY

The presently disclosed subject matter has been devised in view of the above and other problems and characteristics in the conventional art, and to make certain changes to existing lamp electrode structure. Thus, an aspect of the disclosed subject matter includes providing an electrode unit and a fluorescent lamp using the same electrode unit that can meet various requirements for long life, high brightness and the like by preventing spattering. In addition, because the fluorescent lamp can be configured with a simple electrode structure, the fluorescent lamp can enjoy high reliability.

Another aspect of the disclosed subject matter includes providing a CCFL using an electrode unit that can prevent blackening on an inner surface of a glass tube. In one embodiment, even after the CCFL was continuously emitted for 60,000 hours, a decrease of brightness thereof can be less than 50% as compared to the initial brightness value. Thus, the CCFL can be employed as a light source for a backlight unit mounted on the back of an LCD for a television, computer display, and the like.

According to another aspect of the disclosed subject matter, a fluorescent lamp can include: a tube configured in a tubular shape, an inner surface of the tube including a phosphor layer; a couple of electrode units located opposite to each other at each end of the tube, each of the electrode units including an emitter electrode that is configured with a crystalline semiconductor material having an electrical conductivity and formed with a concave portion in a position opposite to each other, and each of the electrode units including a stem lead opposite to the emitter electrode such that the stem lead extends from the tube in order to receive a power supply; a couple of welding beads located between each end of the tube and each of the couple of electrode units, each of welding beads sealing the ends of the tube and the couple of electrode units in an air proof state; and a filler gas located in the glass tube.

In the above-described exemplary fluorescent lamp, each emitter electrode included with the couple of electrode units can be configured with a single-crystal silicon semiconductor or gallium nitride series semiconductor. The concave portion of each emitter electrode can also be formed in a cup shape. In addition, each stem lead can be configured as one body with the same material as the material of each emitter electrode.

According to the above-described exemplary fluorescent lamp, the fluorescent lamp can prevent blackening on an inner surface of the tube thereof by preventing spattering generated from each emitter electrode of the electrode units. In addition, because an electron emitting area of each emitter electrode can become large due to each emitter electrode having concave portions opposite to each other, the fluorescent lamp can enjoy a long life and high brightness with a simple structure.

In this case, because each emitter electrode can be configured with a crystalline semiconductor material having a particular electrical conductivity, each emitter electrode can be produced by a relatively simple manufacturing process and, therefore, the fluorescent lamp including the electrode units can be manufactured with a simple structure. For example, when the concave portion of each emitter electrode is formed in a cup shape, because the crystalline semiconductor material can be formed in a cup shape by a relatively simple manufacturing process such as etching and the like, the fluorescent lamp can be made at low cost because each emitter electrode can be made at low cost.

Furthermore, because a peripheral border of each cup-shaped emitter electrode can prevent electrode matter from being beaten out from a central surface of each emitter electrode and from moving towards the inner surface of the tube, the fluorescent lamp can be configured to prevent blackening of the tube. In this case, when each stem lead is configured as one body with the same material as the material of each emitter electrode, because each of the electrode units is not required to include a connecting process between each emitter electrode and each stem lead, the fluorescent lamp can avoid problems such as failed emission due to unnecessary gas generated from an adhesive material such as an active silver solder and the like used in the connecting process. Thus, the disclosed subject matter can provide a fluorescent lamp having long life and high reliability.

Another aspect of the disclosed subject matter can include the above-described fluorescent lamp, wherein the tube is a glass tube and the couple of welding beads is a couple of glass beads. In addition, the filler gas located in the glass tube can be configured with a single gas or a mixture gas including at least one of helium, neon, argon, krypton, xenon, and radon, and the filler gas can be pressured by a mercury vapor.

According to another aspect of the disclosed subject matter, the fluorescent lamp can be configured as a CCFL having long life, high brightness and high reliability. Thus, the CCFL can be employed as a light source having long life, high brightness and high reliability, which can be used a back light unit for a LCD of a television, computer monitoring, display, and the like.

BRIEF DESCRIPTION OF THE DRAWINGS

These and other characteristics and features of the disclosed subject matter will become clear from the following description with reference to the accompanying drawings, wherein:

FIG. 9 is a chart showing evaluation results with reference to embodiments and comparative examples.

DETAILED DESCRIPTION OF EXEMPLARY EMBODIMENTS

Figure 1:
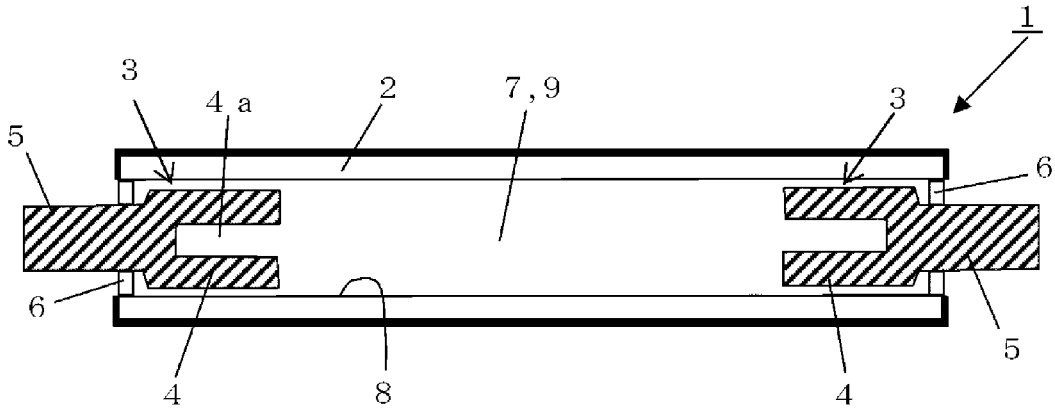
FIG. 1 is a cross-section view showing a structure for an exemplary embodiment of a fluorescent lamp made in accordance with principles of the disclosed subject matter.

Exemplary embodiments of the disclosed subject matter will now be described in detail with reference to FIG. 1 to FIG. 9. FIG. 1 is a cross-section view showing an exemplary embodiment of a fluorescent lamp made in accordance with principles of the disclosed subject matter.

CCFL 1 can be composed of an outer tube 2 and a couple of electrode units 3. The tube 2 can be configured in a cylindrical tubular shape with glass or quartz, etc., and the couple of electrode units 3 can be located opposite to each other at both ends of the tube 2. Each of the electrode units 3 can be composed of an emitter electrode 4 and a stem lead 5. Each emitter electrode 4 can include a concave portion 4*a*, which has a surface shape that can be formed in a cup shape facing towards a tubular space 7 of the tube 2.

Each stem lead 5 can pass through each end of the tube 2. Each end of the tube 2 can be sealed along with each stem lead 5 through a couple of welding beads 6, which can be made from glass, quartz, etc. An inner surface of the tube 2 can include a phosphor layer 8 and a filler gas 9 can be located in the glass tube 2 in an airproof state.

Figure 2:
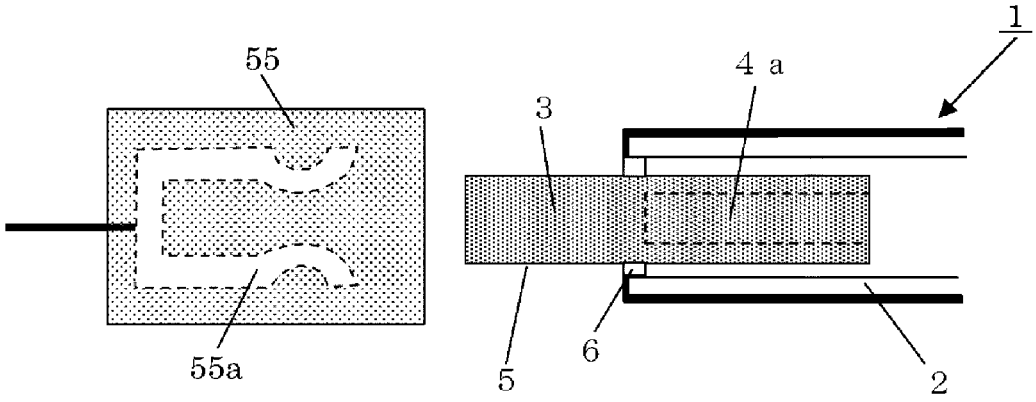
FIG. 2 is a side explanatory diagram showing an attaching structure between a socket and a fluorescent lamp made in accordance with principles of the disclosed subject matter.

FIG. 2 is a side explanatory diagram showing an attaching structure between a socket and a fluorescent lamp made in accordance with principles of the disclosed subject matter. A socket 55 can include a metal plate 55*a* having a spring property therein as shown in FIG. 2. Thus, when the stem lead 5 is inserted between prongs of the metal plate 55*a* of the socket 55, the CCFL 1 can be attached to the socket 55 and can be provided with a power supply via the plate 55*a* of the socket 55. Differences between the stem leads 5 of FIG. 1 and FIG. 2 will be described later in detail.

The CCFL 1 may not be different from a conventional CCFL with respect to some aspects of the tube 2 and the electrode units 3. However, the CCFL 1 made in accordance with principles of the disclosed subject matter can be greatly different from a conventional CCFL in at least the point that each emitter electrode 4 can be configured with a crystalline semiconductor material having an electrical conductivity. The difference and the effect will be described later in detail.

The tube 2 can be configured as a straight tubular glass, for example, a size thereof can be approximately 3.4 mm in outer diameter, 2.4 mm in inner diameter and approximately 300 mm in length. A linear coefficient of expansion of the glass tube 2 can be, for example, 5.1 ppm of kovar glass (Code No. BFK produced by Nippon Electric Glass Co., Ltd.), 3.8 ppm of tungsten glass (Code No. BFW produced by Nippon Electric Glass Co., Ltd.).

The filler gas 9 located in the tube 2 can be, for instance, a mixed gas having a 5:95 Ar (argon)-Ne (neon) ratio and a total pressure thereof can be 60 Torr using a mercury vapor at normal temperature. The phosphor layer 8 formed on the inner surface of the tube 2 can be excited by electrical discharge generated between the electrode units 3 located at either end of the tube 2 such that the phosphor emits a visible light and the like. For example, the phosphor layer 8 can be a layer formed by coating and drying a slurry, which mixes a binder with a phosphor composed of $Y_2O_3$:Eu, BAM and the like.

Each emitter electrode 4 can be composed of a crystalline semiconductor material having an electrical conductivity. Each emitter electrode 4 can include a concave portion 4*a* that is concave in a direction towards the tubular space 7 of the tube 2, respectively. Shapes of the concave portion 4*a* will now be described.

Figure 3:
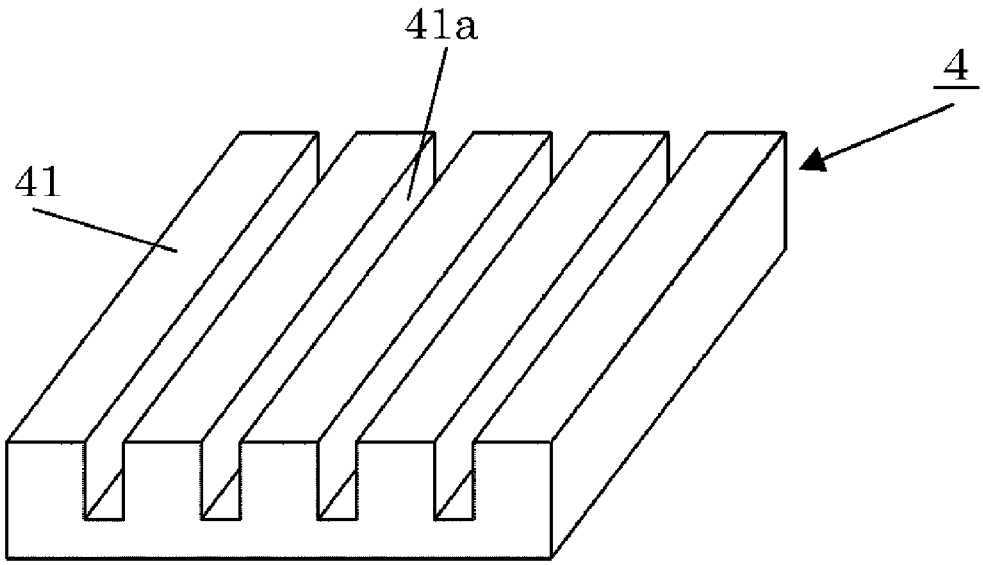
FIG. 3 is an enlarged perspective view showing another exemplary embodiment of an emitter electrode for a fluorescent lamp made in accordance with principles of the disclosed subject matter.

FIG. 3 is an enlarged perspective view showing an exemplary embodiment of an emitter electrode 4 for a fluorescent lamp made in accordance with principles of the disclosed subject matter. The concave shape of concave portion 4*a* is not limited to a cup shape having a substantially U-shape in cross-section as shown in FIG. 1. For example, the concave portion 4*a* can be composed of a plurality of banks 41 and channels 41*a* such as in the emitter electrode 4 shown in FIG. 3. The electrode 4 can also be composed of a grid of channels, or can include a shape having a concave surface on a central portion thereof, etc.

In one embodiment, the shape can be cylindrical with a peripheral border forming the emitter electrode, for instance, a cup shape. In this case, the CCFL 1 having a cup-shaped emitter electrode 4 can prevent blackening of the tube 2. A central portion of each emitter electrode 4 typically generates more spatter than the peripheral border and therefore the peripheral border of each emitter electrode 4 can structurally prevent electrode matter from being beaten out from the central portion of each emitter electrode 4 and from moving towards the inner surface of the tube 2.

On the other hand, when the central portion of each emitter electrode 4 increases in surface area thereof, for example, when formed as a convex such as a cone and the like, blackening may be caused on the inner surface of the tube 2 earlier than with respect to other shapes for the emitter electrode 4. The earlier blackening can be thought to be a result of a lot of spatters generated by concentrating an electric field on the central portion of each emitter electrode 4. Thus, one favorable shape of the central portion of each emitter electrode 4 can be concave.

A description of the crystalline semiconductor material that can be used to make up each emitter electrode 4 will now be given. The crystalline semiconductor material having an electrical conductivity can be, for example, a gallium nitride (GaN) series semiconductor material such as GaN, GaInN and the like, and silicon (Si) semiconductor materials can be used. A single-crystal silicon semiconductor material having an electrical conductivity can be more favorable, because it can be easy to form a large size wafer with stable quality. Therefore, each emitter electrode 4 using the single-crystal silicon semiconductor material can be produced with high quality and at lower cost as compared to other semiconductor materials.

The electrode units 3 which include the above-described emitter electrode 4 can pass through both ends of the tube 2, respectively. The ends of the tube 2 can be sealed in an airproof state via welding beads 6. Each of the welding beads 6 can seal each stem lead 5 at respective ends of the tube 2.

A material for use as welding beads 6 can be, for instance, a frit glass. Thus, the welding beads 6 can prevent a strain from being generated between the tube 2 and each of the stem leads 5 which can otherwise be caused by a different coefficient of thermal expansion between the tube 2 and each of the stem leads 5. When each stem lead 5 and each emitter electrode 4 are combined as one body by a same or similar semiconductor material, both ends of the tube 2 can be sealed by providing the welding beads 6 only at respective sealing portions of each end of the tube 2 as shown in FIG. 1.

Figure 4:
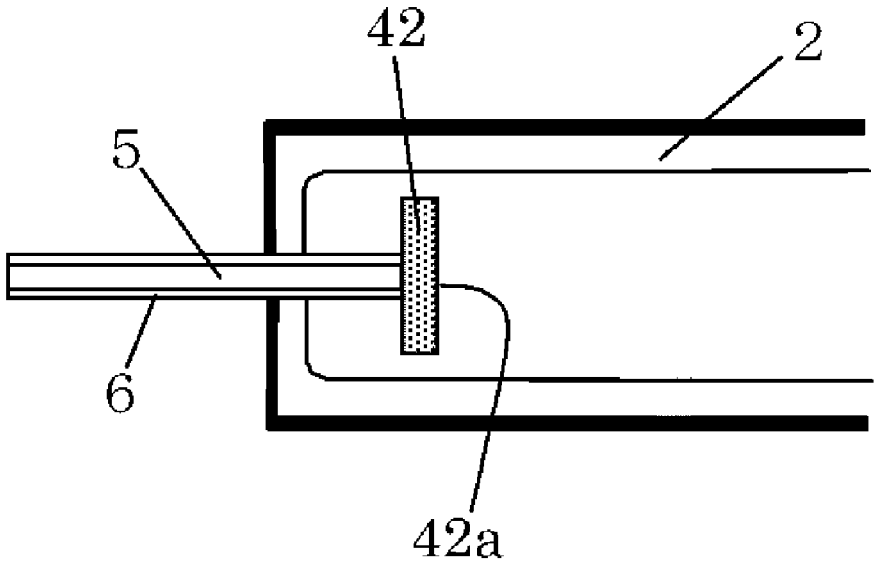
FIG. 4 is a cross-section view depicting another exemplary embodiment of an electrode structure for a fluorescent lamp made in accordance with principles of the disclosed subject matter.

FIG. 4 is a cross-section view depicting another exemplary embodiment of an electrode structure for a fluorescent lamp made in accordance with principles of the disclosed subject matter. When each of the stem leads 5 is configured with a different metal from each of the emitter electrodes 4 such as kovar, molybdenum and the like, each of the stem leads 5 can be provided with a welding bead 6 formed as a preliminary layer around the stem lead 5 and made of a material, such as kovar glass, etc., as shown in FIG. 4. Each of the welding beads 6 can seal each respective end of the tube 2 and each respective stem lead 5 of the electrode units 3.

In this case, as shown in FIG. 4 an emitter electrode 42 can be formed in a tabular shape, which can be connected to the stem lead 5. Each of the emitter electrodes 42 can include a concave portion 42*a* thereon facing towards the tubular space of the tube 2. Each end of the stem leads 5 opposite each of emitter electrodes 42 can be connected to a dumet wire or the like that is formed as a lead wire for connecting to a power source. Thus, each of the stem leads 5 can receive a power supply via the dumet wire.

However, it can be favorable in certain applications of the disclosed subject matter to form both the stem lead 5 and the emitter electrode 4 as one body with the same material of Si semiconductor, for example. An electrode unit that is formed as one body combining both the stem lead 5 and the emitter electrode 4 can be formed by, for example, scraping a predetermined shape from a rod of single-crystal Si. Because the single body electrode unit which combines both the stem lead 5 and the emitter electrode 4 to form a single continuous and integral material structure can be manufactured without a connecting process for connecting the stem lead 5 and the emitter electrode 4, the CCFL 1 can eliminate the need for a connecting portion between the stem lead 5 and the emitter electrode 4.

On the other hand, when the stem lead 5 is formed with a different material as compared to Si semiconductor material, the stem lead 5 can be attached with an adhesive material such as an active silver solder and the like for connecting different materials. For example, in FIG. 4, when connecting an emitter electrode 42 made of Si semiconductor material to a stem lead 5 made of kovar, the structures shown in FIG. 4 can be connected electrically and mechanically using active silver solder or the like.

In this case, the active silver solder can be attached to a predetermined portion of the emitter electrode 42 made of Si semiconductor material and the stem lead 5 made of kovar can be attached to the predetermined portion. Then, the active silver solder can be melted by maintaining a high temperature of 700 degrees centigrade or so under an inert gas atmosphere while in the above-described state such that the emitter electrode 42 of Si semiconductor material can then be connected to the stem lead 5 of kovar by decreasing the temperature and solidifying the active silver solder again.

Thus, because the electrode units 3 of this example may include a connecting process and associated process time for the connecting process, production cost may increase. In addition, it is difficult to maintain a stable and consistent connection because a lot of skill is sometimes necessary for connecting the structures at a constant angle and at a predetermined position. Furthermore, because the CCFL 1 includes active silver solder, in some cases, the CCFL 1 may not emit due to an unnecessary or unwanted gas that is generated from the active silver solder.

However, because the CCFL 1 using electrode units 3 made with a single integral body can be configured to prevent the above-described characteristics and problems, this CCFL 1 can increase the reliability and simplify the manufacturing process. When each stem lead 5 can be combined with each emitter electrode 4 by using the same material of Si semiconductor material for each of the emitter electrode 4 and the stem lead 5, the CCFL 1 can receive a power supply from an outside power source by inserting each stem lead 5 into a socket 55 which includes a metal plate 55*a* biasing towards respective inner sides, as shown in FIG. 2. Thus, such a configuration for a CCFL 1 can also result in a simple connecting structure.

An evaluation of characteristics and operation results will now be described in detail with reference to comparative examples and embodiments in which a CCFL uses semiconductor materials in an emitter electrode.

EMBODIMENT 1

In accordance with a specific example of a lamp made in accordance with principles of the disclosed subject matter, the tube 2 is 3.4 mm in outer diameter, 2.4 mm in inner diameter and approximately 300 mm in length and made from a straight tubular glass. An inner surface thereof includes a phosphor layer 8. The filler gas 9 is a rare gas having 60 Torr in total pressure at normal temperature using a mercury vapor.

Each of the electrode units 3 of this example is formed as shown in FIG. 4. That is to say, a tabular electrode that is cut 2 mm square from an n-type single-crystal Si semiconductor wafer and is used for each of the emitter electrodes 42. Each of the stem leads 5 includes kovar in the shape of a rod. Each of the emitter electrodes 42 is attached to the stem lead 5 that passes through the tube 2 and is sealed along with the glass tube 2. Each of the emitter electrodes 42 is formed with a concave portion 42*a* on a surface thereof facing towards the tubular space of the tube 2, respectively.

After an active silver solder is dispensed in each opening of the emitter electrodes 42 by a dispenser, each of the stem leads 5 is then inserted into each opening of the emitter electrodes 42. The electrode units 3, including both the stem lead 5 and the emitter electrode 42, are heated to a high temperature of 700 degrees centigrade under an inert gas atmosphere of nitrogen gas and are thus connected to each other.

EMBODIMENT 2

Embodiment 2 was made with the same conditions as that of Embodiment 1 except that each of the emitter electrodes 42 is formed as a 2 mm square from an n-type single-crystal GaN wafer in place of the n-type single-crystal Si semiconductor wafer.

COMPARATIVE EXAMPLE 1

Figure 5:
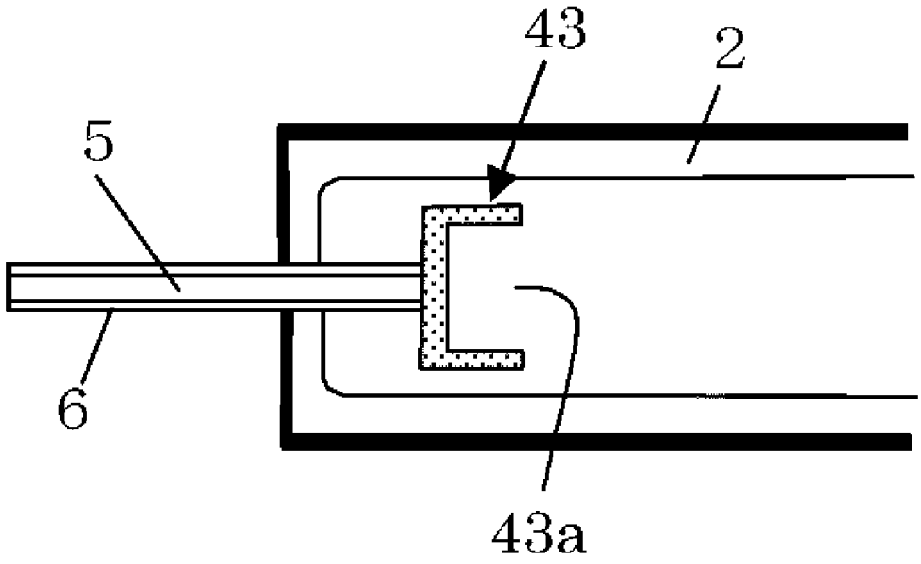
FIG. 5 is a cross-section view depicting another exemplary embodiment of an electrode structure for a fluorescent lamp made in accordance with principles of the disclosed subject matter.

The tube 2 and the filler gas 9 are configured to have the same size and the same material as those of the above-described Embodiment 1. FIG. 5 is a cross-section view depicting another example of an electrode structure for a fluorescent lamp made in accordance with principles of the disclosed subject matter. Each of the electrode portions 3 includes the cup shape as shown in FIG. 5 in place of each emitter electrode 42 formed in a tabular shape as in Embodiment 1.

Each of the emitter electrodes 43 includes a cup-shaped electrode that has a concave portion having a diameter of 2.1 mm and a depth of 5 mm using a nickel (Ni) metal with a thickness of 0.2 mm. The emitter electrode 43 and the stem lead 5 can be welded with an active silver solder, as in Embodiment 1.

COMPARATIVE EXAMPLE 2

The tube 2 and the filler gas 9 are configured with the same size and the same material as those of the above-described Comparative Example 1. The electrode units 3 can have an electrode structure that includes a cup shape as shown in FIG. 5 in place of the emitter electrode 42 formed with a tabular shape in Embodiment 1. Each of the emitter electrodes 43 can include a cup-shaped electrode that includes a concave portion having a diameter of 2.1 mm and a depth of 5 mm using a molybdenum (Mo) metal with a thickness of 0.2 mm. The emitter electrode 43 and the stem lead 5 can be welded with an active silver solder, as in Embodiment 1.

Figure 6:
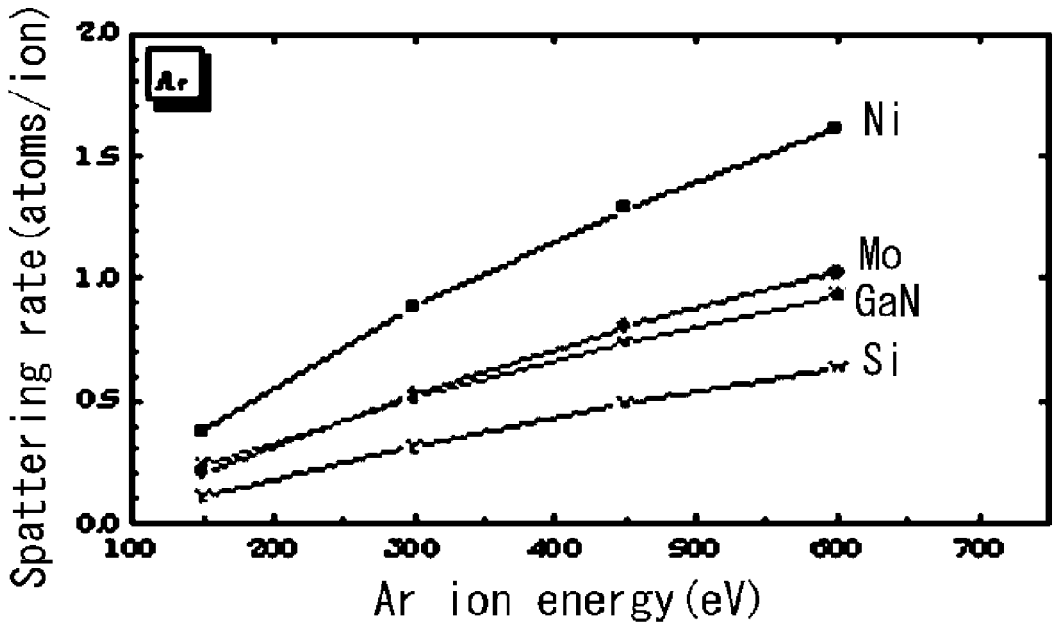
FIG. 6 is a graph showing a spattering rate compared to Ar ion energy.
Figure 7:
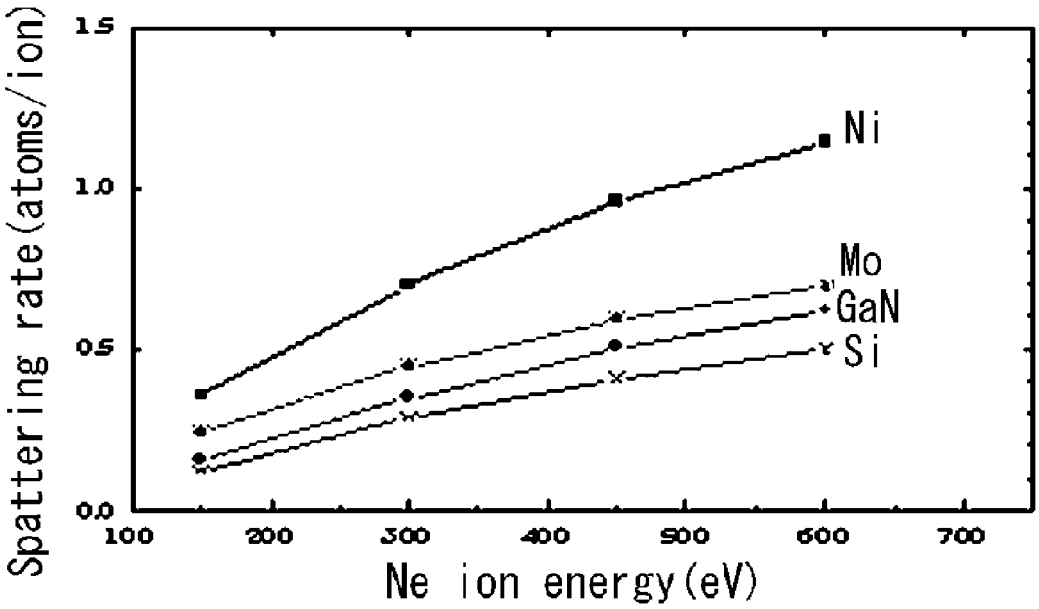
FIG. 7 is a graph showing a spattering rate compared to Ne ion energy.

A resistant characteristic evaluation compared to spattering will be described with reference to the emitter electrode 42 or 43 made from Si, GaN, Ni and Mo in each of Embodiment 1 and Embodiment 2, the Comparative Example 1 and the Comparative Example 2. FIG. 6 is a graph showing a spattering rate compared to Ar ion energy. FIG. 7 shows a spattering rate compared to Ne ion energy, and FIG. 8 shows a spattering rate compared to Hg ion energy.

Figure 8:
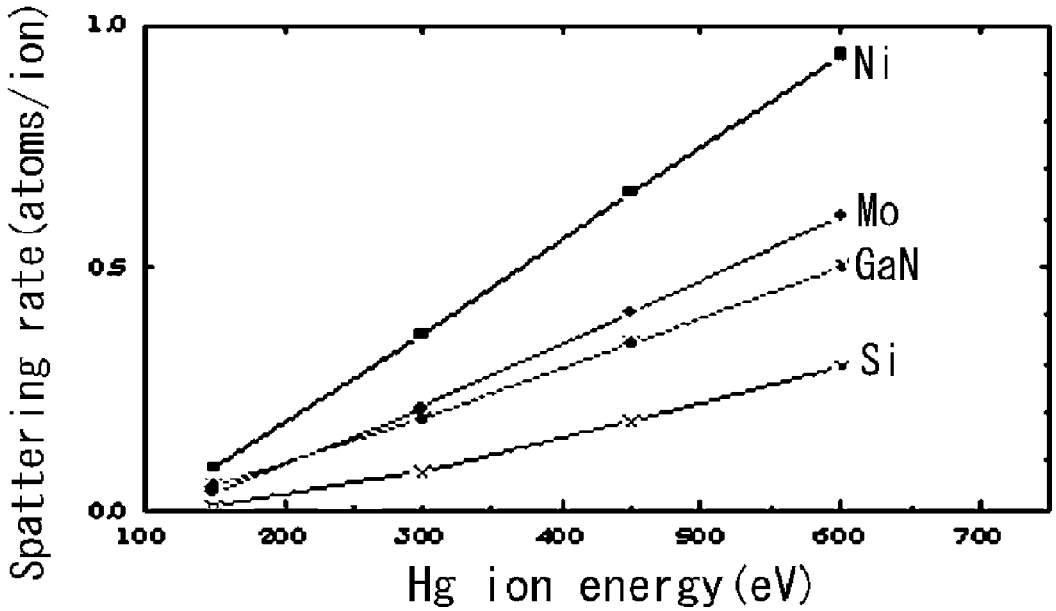
FIG. 8 is a graph showing a spattering rate compared to Hg ion energy.

According to the spattering rates shown in FIGS. 6 to 8, a top-to-bottom ranking can be Ni, Mo, GaN and Si. A spattering rate of Si semiconductor material can be especially the lowest in Ar ion, Ne ion and Hg ion, and thus cannot be easily spattered. When Ne ion is the main ingredient of the filler gas of the CCFL, the spattering rate of Si semiconductor can be approximately half of that of Ni that is generally used and can be about two-third of that of Mo. Thus, the emitter electrode 42 configured with Si semiconductor material can extremely decrease spattering that causes the blackening on the inner surface of the tube of the CCFL.

FIG. 9 is a chart showing an evaluation of characteristics and results with reference to the above Embodiments and Comparative Examples. A remark "x" shown in FIG. 9 denotes a sample that generated a hole on the emitter electrode. A remark "o" denotes a sample that did not generate a hole on the emitter electrode. A remark "-" denotes a sample that did not emit. In obtaining the evaluation of characteristics and results with respect to accelerated life testing time, the samples were evaluated using the same constant current.

The Comparative Example 1 (Ni electrode) generated a hole on the emitter electrode 43*a* at 500 hours and did not emit at more than 1,000 hours. The Comparative Example 2 (Mo electrode) generated a hole on the emitter electrode 43*a* at 2,000 hours and generated a lot of blackening according to a visual examination.

The Embodiment 1 (Si semiconductor electrode) maintained a favorable lighting state even after it was continuously emitted for 2,000 hours to 5,000 hours and did not generate a hole on the emitter electrode 42. In a visual examination, blackening could not be observed in the Embodiment 1 device, and a light state thereof did not differ from that of the initial examination. The Embodiment 2 (GaN electrode) also maintained a favorable lighting state even after it was continuously emitted for 2,000 hours, however, the Embodiment 2 did not emit at more than 5,000 hours.

A life acceleration factor can be approximately 30 times compared to a normal CCFL, of which filler gas is a mixed gas having a 5:95 Ar (argon)-Ne (neon) ratio and a total pressure of 60 Torr using a mercury vapor at normal temperature. Thus, an acceleration lifetime of more than 2,000 hours can correspond to a lifetime of 60,000 hours in a normal CCFL.

According to the above-described evaluation of characteristics and results, when each of the emitter electrodes 4 were configured with a crystalline silicon semiconductor material having an electrical conductivity, each of the emitter electrodes 4 prevented blackening on the inner surface of the tube 2. In addition, according to a relation between the accelerated life test and normal life, the CCFL 1 in accordance with Embodiment 1 can be described as having a long life and being configured to avoid a decrease of brightness with respect to initial brightness, such that brightness decreases less than 50% as compared to initial brightness even after the lamp is continuously caused to emit light for 60,000 hours.

An evaluation of results of other shapes of the emitter electrode 4 using the same n-typed single-crystal Si semiconductor wafer will now be given.

Embodiment 3

Embodiment 3 was made with the same conditions as that of Embodiment 1 except that each of the emitter electrodes 42 was formed as a 2 mm square from an n-type single-crystal Si semiconductor wafer and without the concave portion 42*a*.

Embodiment 4

Embodiment 4 was made with the same conditions as that of Embodiment 1 except that each of the emitter electrodes 43 was formed with a U-shaped cross-section and included a peripheral wall by forming the concave portion 43*a* on the central portion thereof with an etching process as shown FIG. 5.

Embodiment 5

Embodiment 5 was made under the same conditions as that of Embodiment 1 except that both the emitter electrode 4 and the stem lead 5 were configured as one straight pin with the same Si semiconductor material by forming each of electrode units 3 like a straight pin from a rod of single-crystal Si semiconductor.

In an accelerated life test up to 2,000 hours, the samples of Embodiment 3 and Embodiment 4 did not differ from the sample of Embodiment 1, which can maintain a favorable lighting state. In the visual examination for blackening, Embodiment 3 can be better than those of Comparative Examples 1 and 2, however, Embodiment 3 generated blackening more than both Embodiment 1 and Embodiment 4.

Embodiment 5 can be better with respect to the sealing activity required of the electrode units 3 as compared to the other samples. However, Embodiment 5 generated blackening on the inner surface of the tube 2 more than those of Embodiments 1 and 3. Because each end shape of the emitter electrodes 4 was formed like a needle, each end of the emitter electrodes 4 can be thought to generate the spattering by concentrating an electric field thereto.

Thus, the disclosed subject matter can provide a CCFL having a long life and a high brightness and can be used as a light source for a backlight unit for a LCD unit of a television, display, and the like. The CCFL can conform to various requirements for long life and high brightness by using the above-described electrode units which can include the emitter electrode that is configured with a crystalline semiconductor material such as a Si semiconductor material having an electrical conductivity and formed with a concave portion thereon. Furthermore, because the CCFL can be manufactured with a simple structure, the disclosed subject matter can provide, among the other things, a CCFL having high reliability.

In the above-described exemplary embodiments, a CCFL using electrode units that include an emitter electrode and that is configured with a crystalline semiconductor material having an electrical conductivity is described. However, the disclosed subject matter is not limited to the above-described embodiments of a CCFL, and can be used in other types of fluorescent lamps and the like without departing from the spirit and scope of the presently disclosed subject matter.

While there has been described what are at present considered to be exemplary embodiments of the invention, it will be understood that various modifications may be made thereto, and it is intended that the appended claims cover such modifications as fall within the true spirit and scope of the invention. All conventional art references described above are herein incorporated in their entirety by reference.

What is claimed is:

1. A fluorescent lamp comprising:

a tube configured in a tubular shape having a first end and a second end, an inner surface of the tube including a phosphor layer;

at least one first electrode unit located at the first end of the tube, the electrode unit including an emitter electrode configured with a crystalline semiconductor material having an electrical conductivity and including a concave portion facing towards the second end of the tube, and the electrode unit including a stem lead located opposite to the emitter electrode and extending away from the tube in order to receive a power supply, wherein the stem lead and emitter electrode are configured as one integral and continuous body made from the same material;

at least one welding bead located between the first end of the tube and the electrode unit, the welding bead sealing the first end of the tube with the electrode unit in an air proof state; and a filler gas located in the tube.

2. The fluorescent lamp according to claim 1, wherein the emitter electrode is configured with at least one of a single-crystal silicon semiconductor material and a gallium nitride series semiconductor material.

3. The fluorescent lamp according to claim 2, wherein the concave portion of the emitter electrode is formed as a cup shape.

4. The fluorescent lamp according to claim 2, wherein the tube is a glass tube and the welding bead is a glass bead.

5. The fluorescent lamp according to claim 4, wherein the filler gas is configured with a single gas or a mixture gas, and includes at least one of helium, neon, argon, krypton, xenon and radon, and the filler gas is pressured by a mercury vapor.

6. The fluorescent lamp according to claim 1, wherein the concave portion of the emitter electrode is formed as a cup shape.

7. The fluorescent lamp according to claim 1, wherein the tube is a glass tube and the welding bead is a glass bead.

8. The fluorescent lamp according to claim 7, wherein the filler gas is configured with a single gas or a mixture gas, and includes at least one of helium, neon, argon, krypton, xenon and radon, and the filler gas is pressured by a mercury vapor.

9. The fluorescent lamp according to claim 1, wherein the emitter electrode is configured of a single-crystal silicon semiconductor material.

10. The fluorescent lamp according to claim 9, wherein the filler gas is configured with a single gas or a mixture gas, and includes at least one of helium, neon, argon, krypton, xenon and radon, and the filler gas is pressured by a mercury vapor.

11. The fluorescent lamp according to claim 1, wherein the emitter electrode is configured of a gallium nitride series semiconductor material.

12. The fluorescent lamp according to claim 11, wherein the filler gas is configured with a single gas or a mixture gas, and includes at least one of helium, neon, argon, krypton, xenon and radon, and the filler gas is pressured by a mercury vapor.

13. The fluorescent lamp according to claim 1, wherein the emitter electrode is configured of GaN.

14. The fluorescent lamp according to claim 1, wherein the emitter electrode is configured of GaInN.

15. The fluorescent lamp according to claim 1, wherein the emitter electrode is configured of a silicon semiconductor material.

16. The fluorescent lamp according to claim 1, wherein the emitter electrode is configured of an n-type semiconductor material.

17. The fluorescent lamp according to claim 1, further comprising:

a second electrode unit located at the second end of the tube, the second electrode unit including a second emitter electrode configured with a crystalline silicon semiconductor material and having a concave portion facing toward the concave portion of the first electrode unit.

* * * * *